US011029116B2

(12) United States Patent
Biegel

(10) Patent No.: US 11,029,116 B2
(45) Date of Patent: Jun. 8, 2021

(54) TRIGGER MECHANISM FOR FIREARMS

(71) Applicant: CMC Triggers Corp., Fort Worth, TX (US)

(72) Inventor: Jack Richard Biegel, Arlington, TX (US)

(73) Assignee: CMC Triggers Corp., Fort Worth, TX (US)

( * ) Notice: Subject to any disclaimer, the term of this patent is extended or adjusted under 35 U.S.C. 154(b) by 0 days.

(21) Appl. No.: 16/743,221

(22) Filed: Jan. 15, 2020

(65) Prior Publication Data

US 2020/0224988 A1 Jul. 16, 2020

Related U.S. Application Data

(60) Provisional application No. 62/792,593, filed on Jan. 15, 2019.

(51) Int. Cl.
*F41A 19/34* (2006.01)
*F41A 17/46* (2006.01)

(52) U.S. Cl.
CPC ..... *F41A 19/34* (2013.01); *F41A 17/46* (2013.01)

(58) Field of Classification Search
CPC ..... F41A 19/34; F41A 19/10; F41A 19/12; F41A 19/16; F41A 19/31; F41A 19/30; F41A 17/46
USPC ..... 42/69.02
See application file for complete search history.

(56) References Cited

U.S. PATENT DOCUMENTS 2,249,232 A * 7/1941 Smith ..... F41A 19/31 42/69.02
2,514,981 A 7/1950 Walker et al.
2,775,836 A * 1/1957 Emerson ..... F41A 19/31 42/69.02
3,707,796 A * 1/1973 Bielfeldt ..... F41A 19/17 42/70.05
3,755,951 A 9/1973 Koon, Jr.
3,950,876 A 4/1976 Wild et al.
4,005,540 A * 2/1977 Robinson ..... F41A 19/16 42/69.01
4,671,005 A * 6/1987 Jewell ..... F41A 17/46 42/69.02
4,730,406 A * 3/1988 Forbes ..... F41A 17/32 42/70.01
5,109,622 A 5/1992 Echeberria
(Continued)

*Primary Examiner* — John Cooper
(74) *Attorney, Agent, or Firm* — Wood Herron & Evans LLP

(57) ABSTRACT

Provided is a trigger mechanism having a housing, a trigger member, a trigger dog, and a striker dog. The trigger member is pivotally mounted in the housing, movable between set and pulled positions. The trigger dog is pivotally mounted in the housing and a first lever arm portion of the trigger dog engages a lever arm portion of the trigger member by a first over-center linkage. The striker dog is pivotally mounted in the housing, movable between set and released positions with a lever arm portion engaged to a second lever arm portion of the trigger dog by a second over-center linkage. The over-center linkages are configured to inhibit rotation of the striker dog from the set position to the released position until the trigger member is manipulated from the set position to the pulled position with a force greater than an engagement threshold of the over-center linkages.

9 Claims, 11 Drawing Sheets

(56) References Cited

U.S. PATENT DOCUMENTS 5,363,581 A * 11/1994 Blenk ..... F41A 19/31 42/69.02
5,485,776 A * 1/1996 Ealovega ..... F41A 19/03 89/130
5,487,233 A * 1/1996 Jewell ..... F41A 19/16 42/69.01
5,551,180 A * 9/1996 Findlay ..... F41A 17/32 42/70.01
5,752,338 A * 5/1998 Lameiras Guede .... F41A 17/46 42/70.06
5,784,818 A 7/1998 Otteson
6,681,511 B1 1/2004 Huber
6,978,568 B2 * 12/2005 Jewell ..... F41A 19/16 42/69.02
8,099,895 B2 1/2012 Farley, Jr. et al.
8,132,349 B1 * 3/2012 Huber ..... F41A 19/12 42/69.02
8,677,665 B1 * 3/2014 Huber ..... F41A 17/56 42/70.04
9,032,656 B2 * 5/2015 Lupher ..... F41A 17/46 42/69.01
9,255,750 B1 2/2016 Huber
10,578,385 B2 * 3/2020 Dextraze ..... F41A 19/16
10,767,950 B2 * 9/2020 Lake ..... F41A 19/12
2005/0183311 A1 * 8/2005 Diaz ..... F41A 19/16 42/69.01
2010/0175291 A1 * 7/2010 Farley, Jr. ..... F41A 19/10 42/69.01
2011/0030261 A1 2/2011 Karagias
2012/0131832 A1 * 5/2012 Arduini ..... F16D 43/04 42/69.01
2012/0137556 A1 * 6/2012 Laney ..... F41C 23/16 42/6
2014/0373417 A1 * 12/2014 Arnedo Vera ..... F41A 19/06 42/69.01
2015/0253094 A1 * 9/2015 Reynolds ..... F41A 19/10 42/69.01

* cited by examiner

TRIGGER MECHANISM FOR FIREARMS

RELATED APPLICATION

This application is a Non-provisional application claiming priority to U.S. Provisional Patent Application No. 62/792,593, filed Jan. 15, 2019, and incorporates the same herein by reference.

TECHNICAL FIELD

This invention relates to a trigger mechanism for use in a firearm. More particularly, it relates to a trigger mechanism for use in a bolt-action rifle.

BACKGROUND

Bolt-action rifles are particularly suited for long-range and/or precision shooting because the barreled action may be firmly supported in a stock or chassis and firing requires minimal movement of a minimum number of parts. Additionally, because the action is cycled manually, all of the energy produced by the burning propellant powder is used to accelerate the projectile in the barrel and there are no automatically cycled parts moving that may transmit vibrations to other parts of the firearm.

A variety of trigger mechanisms have been proposed, designed, and made for bolt-action rifles. For any such trigger mechanism, it is imperative that the cocked striker inside the bolt be released every time the trigger is pulled and that it never be released unless the trigger is pulled. Various designs have been proposed to ensure such safety. However, in recent years, even widely used designs have been found to be unsafe and to allow an unintended discharge under certain conditions.

For precision shooting, it is desirable to have a trigger mechanism requiring minimal movement of the trigger and an ability to adjust the amount of force required to pull the trigger. The trigger mechanism needs to release with a crisp "break" with minimal internal friction as the mechanism's parts move relative to each other.

SUMMARY OF THE INVENTION

The present invention provides a trigger mechanism for a bolt-action firearm with a manual safety, minimal trigger pull length, externally adjustable trigger force, and a bolt-release mechanism that is captive to the trigger assembly. The mechanism utilizes a double over-center linkage to minimize internal friction and ensure safety by precluding unintended discharge by any other means.

The trigger mechanism includes a housing with a trigger member pivotally mounted therein. The trigger member is movable between set and pulled positions. A trigger dog is pivotally mounted in the housing and has a first lever arm portion engaged to a lever arm portion of the trigger member by a first over-center linkage. A striker dog is pivotally mounted in the housing and is movable between set and released positions. The striker dog has a lever arm portion engaged to a second lever arm portion of the trigger dog by a second over-center linkage. The over-center linkages are configured to inhibit rotation of the striker dog from the set position to the released position until the trigger member is manipulated from the set position to the pulled position with a force greater than an engagement threshold of the over-center linkages.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
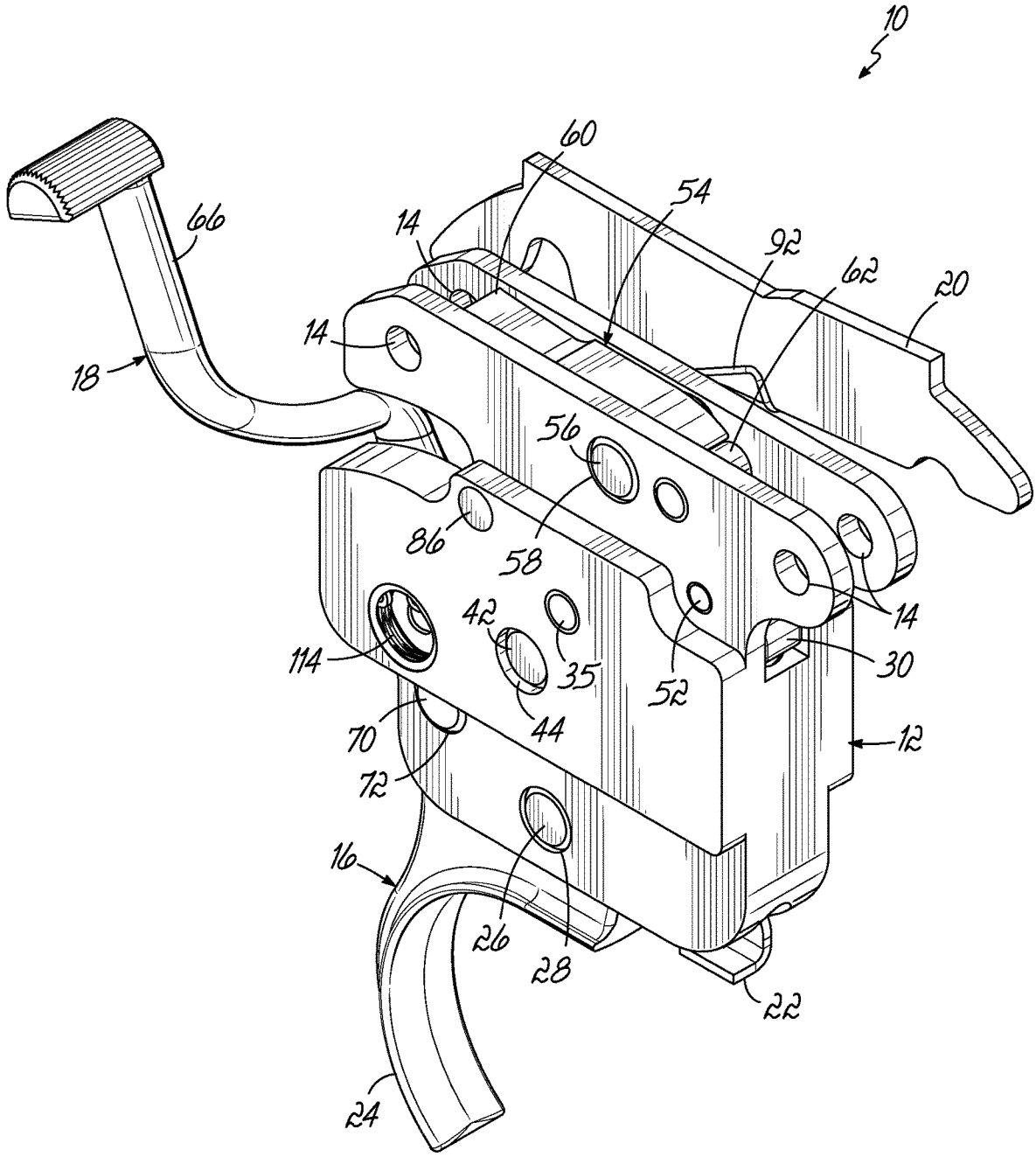
FIG. 1 is a first isometric view of a trigger mechanism assembly according to one embodiment of the present invention.
Figure 2:
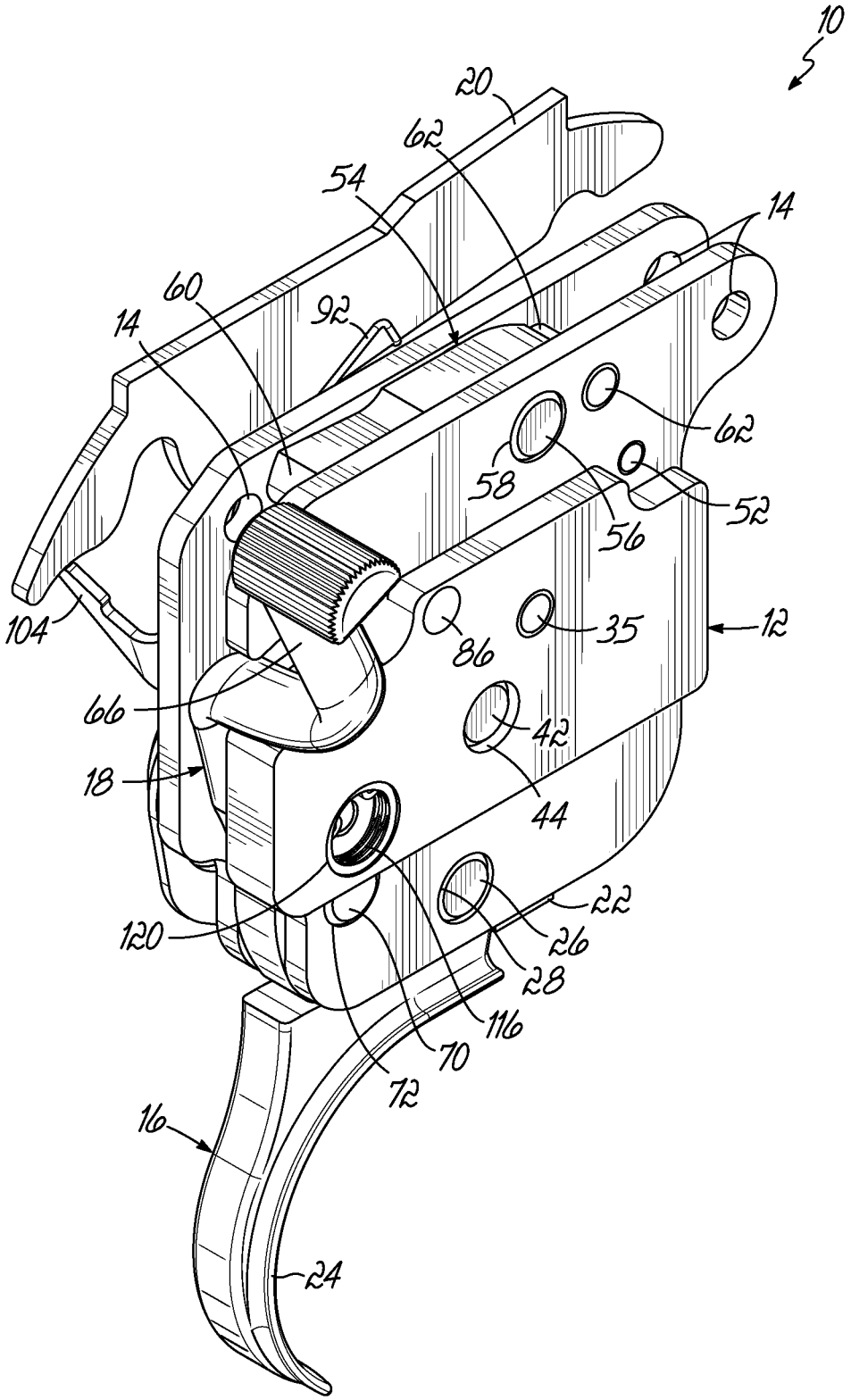
FIG. 2 is a second isometric view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner. As used herein, "firearm" can encompass air guns, muzzle-loading arms, and/or other similar devices.

Figure 3:
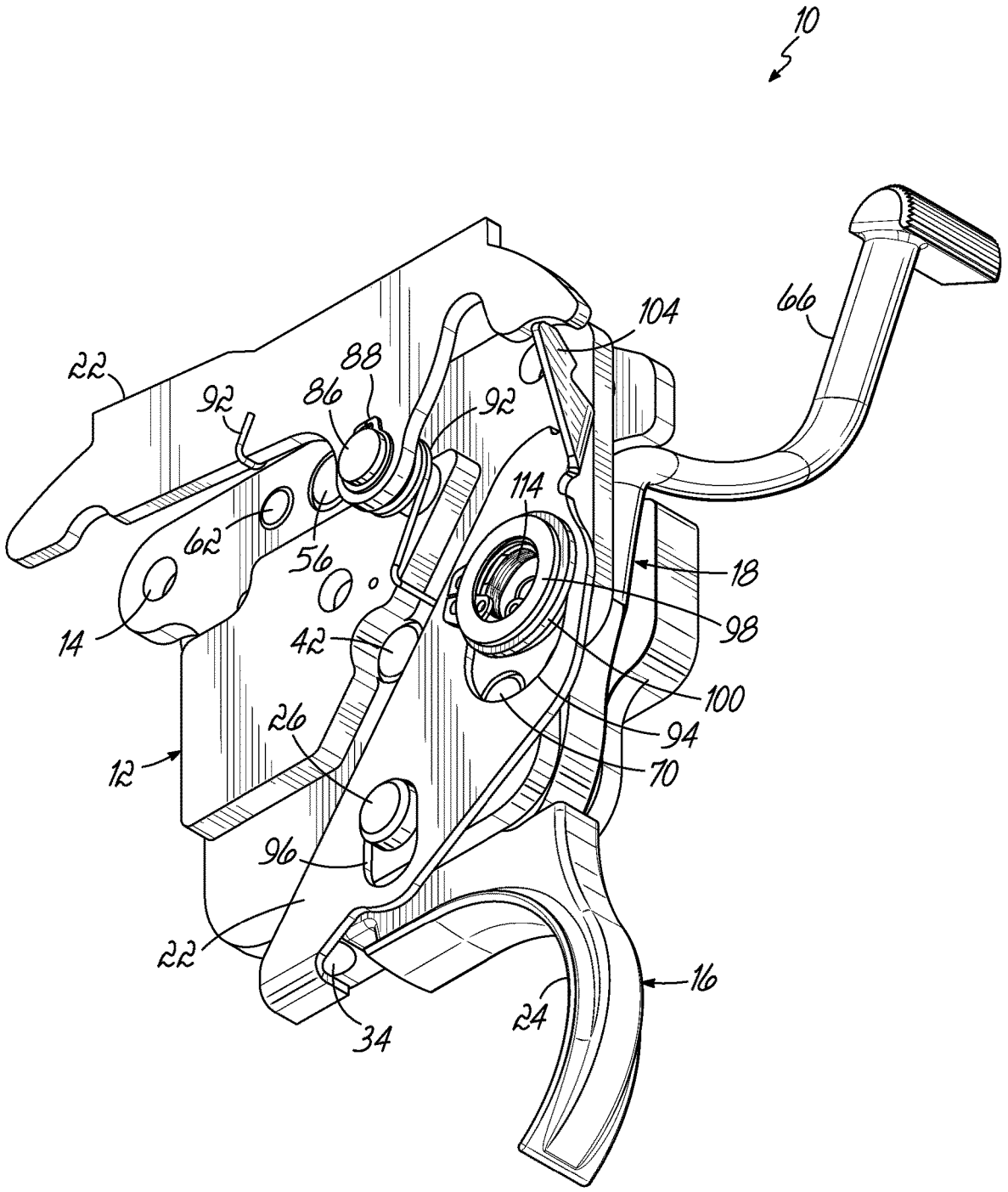
FIG. 3 is a third isometric view thereof.
Figure 4:
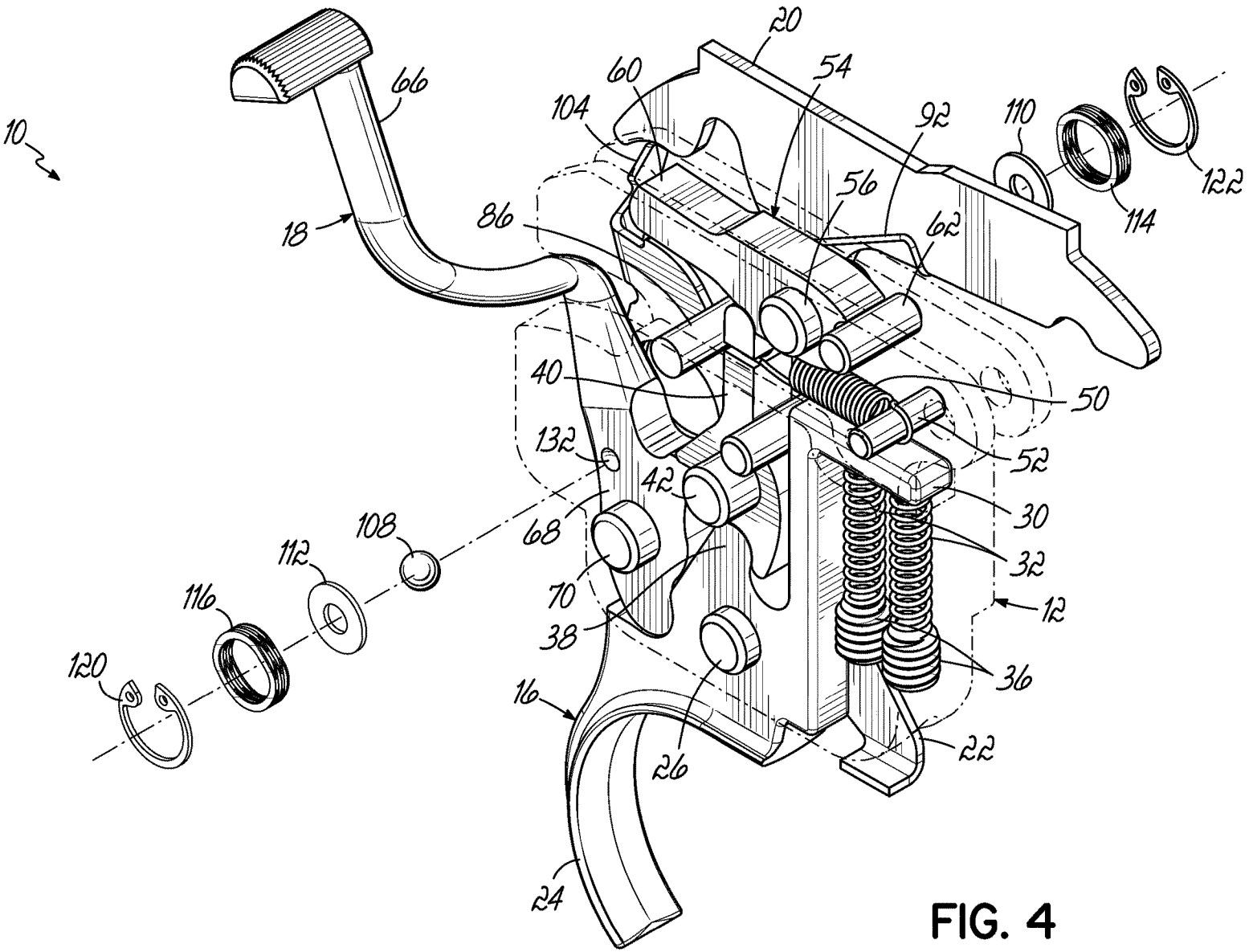
FIG. 4 is a fourth isometric view thereof, with safety detents shown in an exploded position.

Referring first to FIGS. 1-4, therein is shown at 10 a trigger assembly according to one embodiment of the invention. While the invention may be adapted to most any bolt-action pattern, the illustrated embodiment is configured to fit the popular Remington 700 pattern receiver. The entire mechanism of the trigger assembly 10 is supported by a housing 12. The housing 12 may be milled from a billet of suitable material, such as steel or an aluminum alloy, may be cast in metal or suitable polymer material, may be "printed" by an additive machining process, or may be assembled from components into a unitary part. The housing 12 (and, thereby, the entire trigger assembly 10) is attached to the receiver and/or stock using assembly pins (not shown) that pass through openings 14 near the top of the housing 12. Unlike some other designs, the assembly pins in this embodiment are not used to support any other parts of the trigger mechanism or to act as a pivot axle. As will be described later in greater detail, the housing 12 pivotally supports a trigger member 16 and a manual safety 18. As best shown in FIG. 3, on the left side of the housing 12, a bolt stop 20 and release lever 22 are mounted captive to the assembly 10. This configuration allows the trigger assembly 10 to be a complete "drop-in" unit without separate parts that require further assembly during installation.

Figure 5:
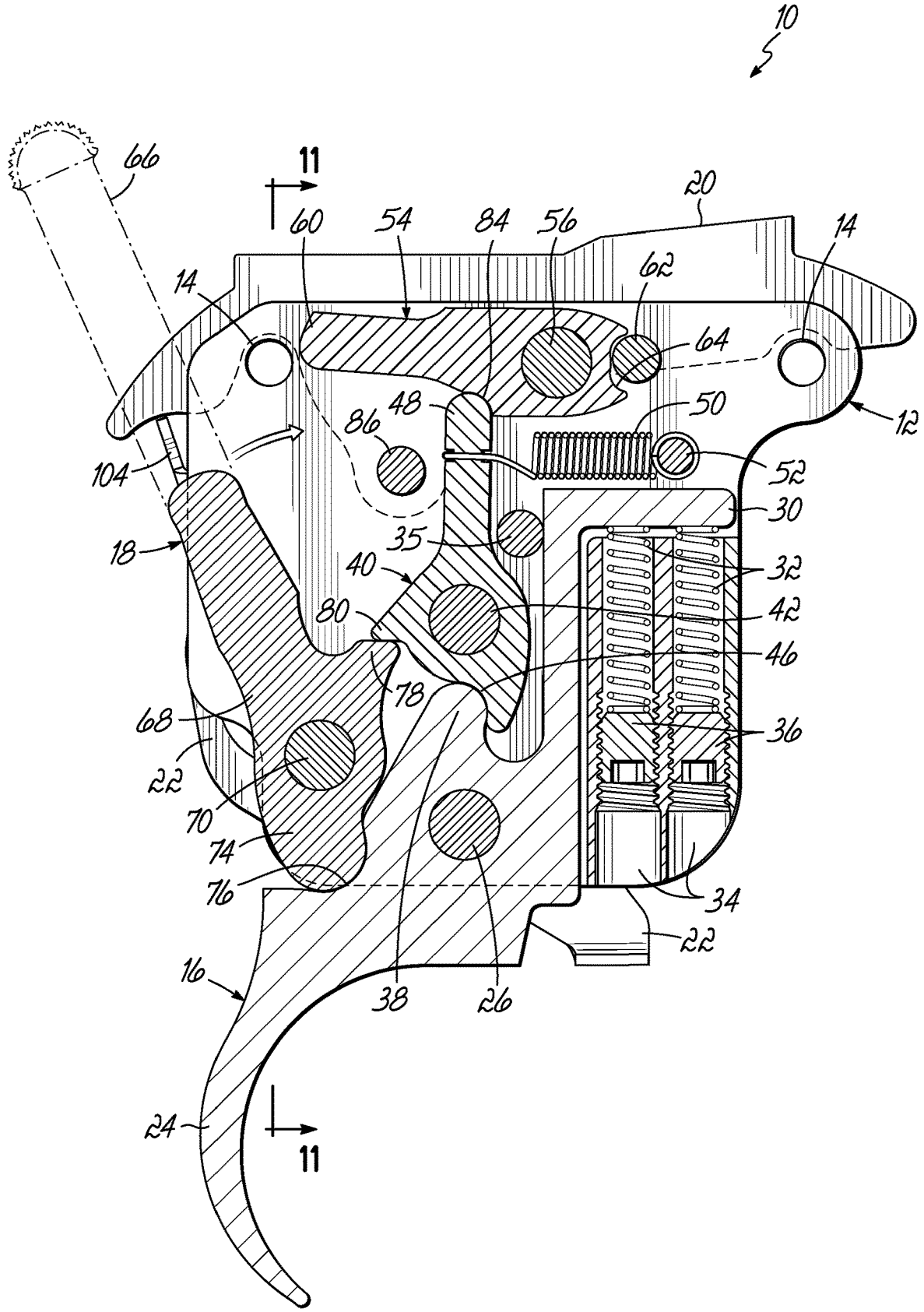
FIG. 5 is a right side sectional view of the mechanism in a SAFE condition.

Referring now also to FIG. 5, four moving parts are supported on pivot axles (pins) within and between sidewalls of the housing 12. The trigger member 16 includes a finger lever 24, which may be of any desired style or shape. The trigger member 16 is pivotally supported on a trigger pin 26 that extends through aligned opposite openings 28 in sidewalls of the housing 12. The trigger member 16 includes a spring finger portion 30 that extends generally upwardly and forward to engage one or more trigger springs 32. The trigger springs 32 are received in partially threaded bores 34 so that one end is in contact with the spring finger portion 30. This portion of the housing 12 serves to connect the sidewalls so that the housing 12 is generally open to the front above it, generally open to the bottom behind it, and generally open to the rear and top. The springs 32 bear against the spring finger portion 30 to bias the trigger member 16 toward a reset position (shown in FIG. 5). A stop pin 35 limits the travel of the trigger 16 toward the reset position. Compression force of the springs 32 against the spring finger 30 may be adjusted, such as with threaded set screws 36 and/or by selecting springs 32 having a different compression force. The set screws 36 may be adjusted, such as with a hex wrench, while the trigger assembly 10 is installed on a receiver and in a stock or chassis via the gap left within the trigger guard that provides access to the bolt stop release lever 22 (see FIGS. 8 and 9). The springs 32 may be adjusted and/or replaced individually to provide a user-selected trigger pull weight from a few ounces to a few pounds. Extending generally upward above the trigger pin 26, the trigger member 16 includes a trigger lever arm portion 38.

A trigger dog 40 is situated within the housing 12, generally above the trigger member 16, and is pivotally supported on a pivot pin 42 that extends between opposite openings 44 in sidewalls of the housing 12. The trigger dog 40 includes a socket 46 that receives a lobe of the lever arm portion 38 of the trigger member 16 and acts as a first lever arm portion. Opposite the socket 46, the trigger dog 40 has a second lever arm portion 48 that extends radially away from the pivot pin 42 a significantly greater distance than is the socket 46 from the pivot pin 42. A tension spring 58 anchored to the housing 12 by a cross pin 52 is attached to the lever arm portion 48 of the trigger dog 40 and biases it toward a reset position (clockwise, as viewed in FIG. 5).

Near the top of the housing 12, a striker dog 54 is pivotally mounted on a pivot pin 56 which extends between openings 58 in sidewalls of the housing 12. The striker dog includes a striker-engaging portion 60 which extends radially from the pivot pin 56 in a generally rearward direction. The striker dog 54 is in the form of a "Class 3 lever" (i.e., a lever in which the effort is between the fulcrum and the load). The manner in which the striker engaging portion 60 interacts with the striker of a bolt-action firearm is well-known. The heavy forward spring force of the striker will push the striker dog 54 down as soon as upward support is removed. A stop pin 62 located generally forward of the striker dog 54 engages a notch 64 to limit its pivotal movement.

Unlike many other designs, the manual safety mechanism in this embodiment is supported inside the housing 12. The manual safety lever 18 includes a handle 66 that project to the exterior of the stock or chassis for manipulation by the user. A body portion 68 is situated within the housing 12 and pivotally mounted on a pivot pin 70 that extends between laterally aligned openings 72 in the sidewalls of the housing 12. The body portion 68 has a lower lobe 74 that engages a socket 76 in the trigger member 16 when in the SAFE position (shown in FIG. 5). An upper lob 78 of the body portion 68 acts as a stop for a safety finger 80 that extends from the trigger dog 40 while in the SAFE position. In the SAFE condition, the trigger 16 and trigger dog 40 are both mechanically blocked against any movement from the reset position. In turn, the striker dog 54 is mechanically blocked from movement by the trigger dog 40. The relatively larger diameter of the component pivot pins 26, 42, 56, 70 reduces friction and facilitates rotation.

Figure 6:
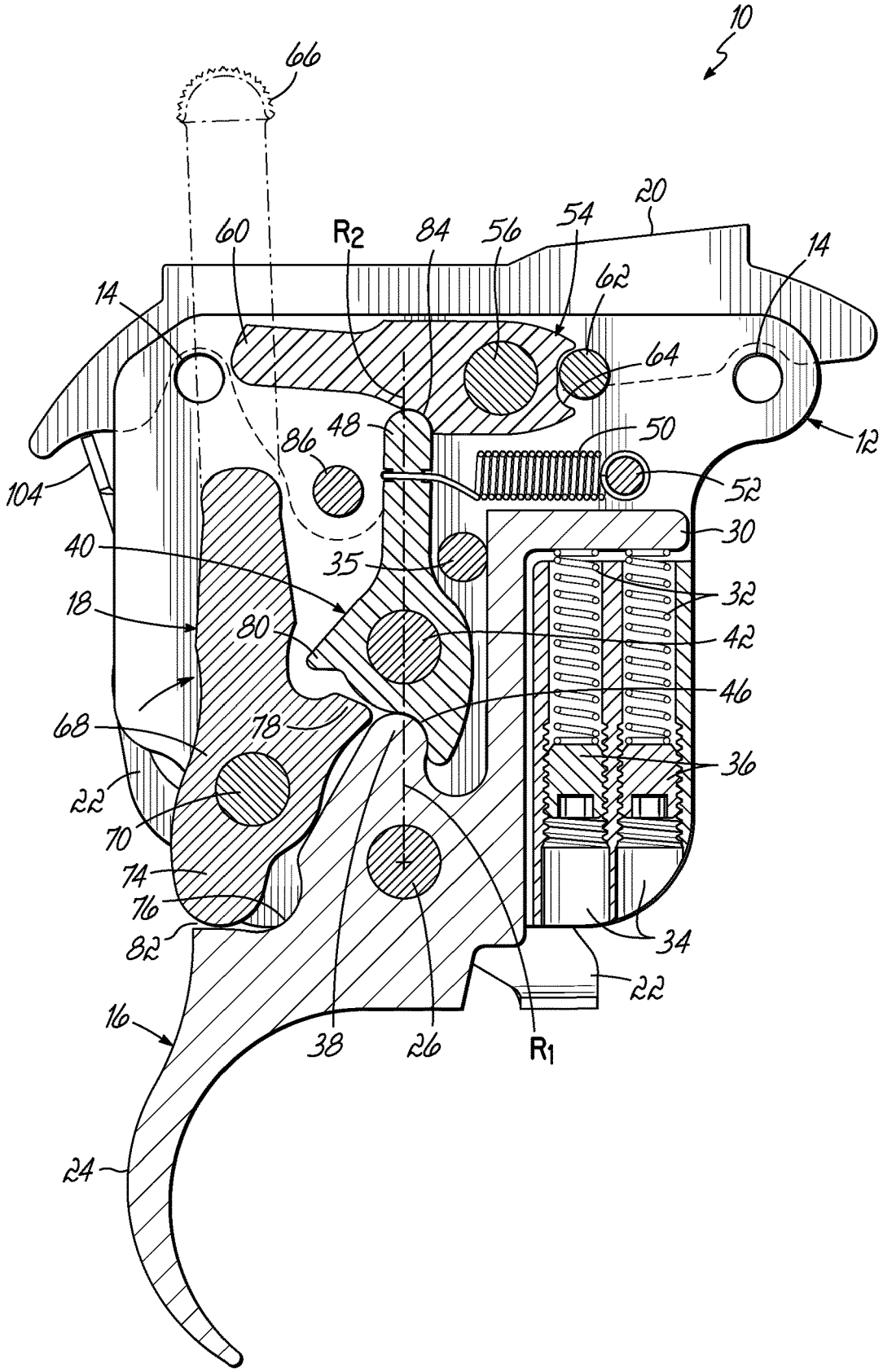
FIG. 6 is a similar view with the manual safety moved to the FIRE position.

Referring now to FIG. 6, when the handle 66 of the manual safety lever 18 is pushed forward, the body portion 68 is rotated (as shown by an arrow) to the FIRE position. When rotated as shown, the lower lobe 74 of the body portion 68 is moved out of the socket 76 of the trigger member 16. A small but adequate gap 82 is left to allow pivotal movement of the trigger member 16. Likewise, the upper lobe 78 of the body portion 68 is moved away from blocking contact with the safety finger 80 of the trigger dog 40.

Referring still to FIG. 6, the trigger actuation mechanism provides a double over-center lock-up and release feature. As shown by centerline $R_1$, the center point of the trigger's lever arm portion 38 is off of the centerline between pivot points of the trigger member 16 and trigger dog 40. Rotation requires that the center point cross the centerline $R_1$, exceeding an engagement threshold necessary to pass the dead-center point. Likewise, the center point of the trigger dog's lever arm portion 48 is off the centerline ($R_2$) between the lever arm portion 48 and the release shoulder of the socket 84 in the striker dog 54. Thus, even when the manual safety lever 18 is in the FIRE position, more than the force of the trigger springs 32 is holding all three members 16, 40, 54 in the reset position. Two separate over-center linkages must be displaced for the striker dog 54 to release the striker. This can provide an additional degree of safety not found in other trigger designs.

Figure 7:
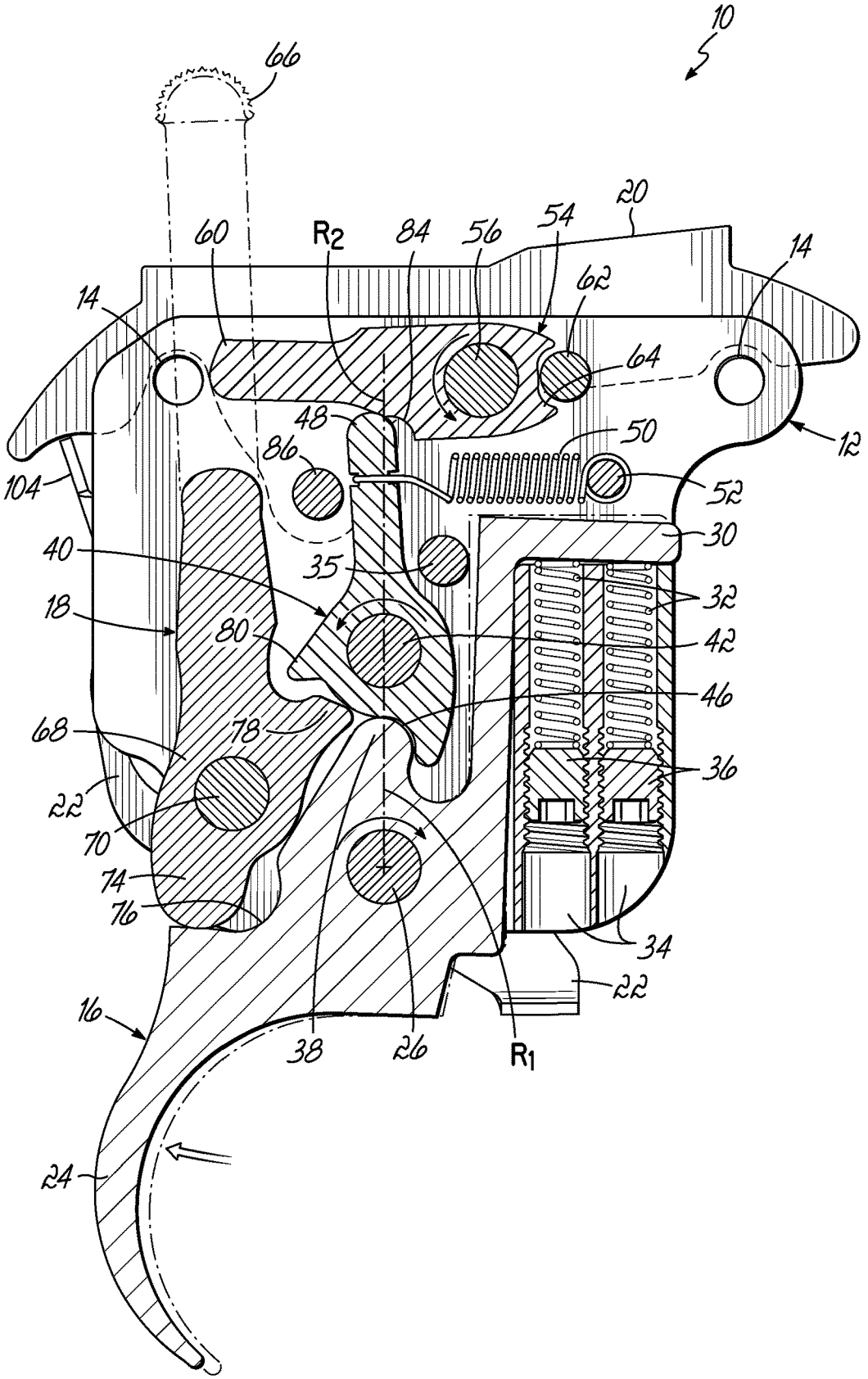
FIG. 7 is a similar view showing the position of internal components after the trigger has been pulled.

Referring now, by comparison, to FIG. 7, when the finger lever 24 of the trigger member 16 is pulled to the rear (shown by an arrow), rotation of the trigger member 16 rolls the lever arm 38 out of the socket 46 of the trigger dog 40 as the trigger dog 40 is rotated in an opposite direction (see rotational arrows in FIG. 7). As the trigger dog 40 rotates (counter-clockwise as shown in FIG. 7.), the lever arm portion 48 slides over the shoulder of the striker dog socket 84, allowing the striker dog 84 to rotate, collapsing under the force of the striker, which is released. In the illustrated embodiment, the end of the finger lever 24 need move only 0.035 inch (about 1.2 degrees of rotation) from "reset" to "fire."

The force of the striker bearing against the engaging portion 60 of the striker dog 54 causes both the striker dog 54 and trigger dog 40 to "collapse" and rotate to their limits. The tension of the trigger dog spring 56 is readily overcome and the trigger dog 40 is free to continue rotation past the centerline $R_2$ or "break" point. Movement of the trigger dog 40 is limited only by the bolt release pivot pin 86, to be described later. Movement of the striker dog 54 is limited by the notch 64 and pin 62. Once the striker is released and is no longer pushing the striker dog 54 down, the tension of the trigger dog spring 50 returns the trigger dog 40 back toward its reset position, which lifts the striker dog 54. Release of finger pressure on the trigger member 16 allows the trigger springs 32 to rotate it back toward its reset position. This rotation rolls the lobe of the lever arm portion 38 into the socket 46 of the trigger dog and reseats the lobe of the trigger dog's lever arm portion 48 into the socket 84 of the striker dog 54 (which acts as a lever arm portion of the striker dog 54), returning the linkage to its double over-center reset position (shown in FIG. 6). The striker is then re-cocked by manually cycling the bolt.

Figure 8:
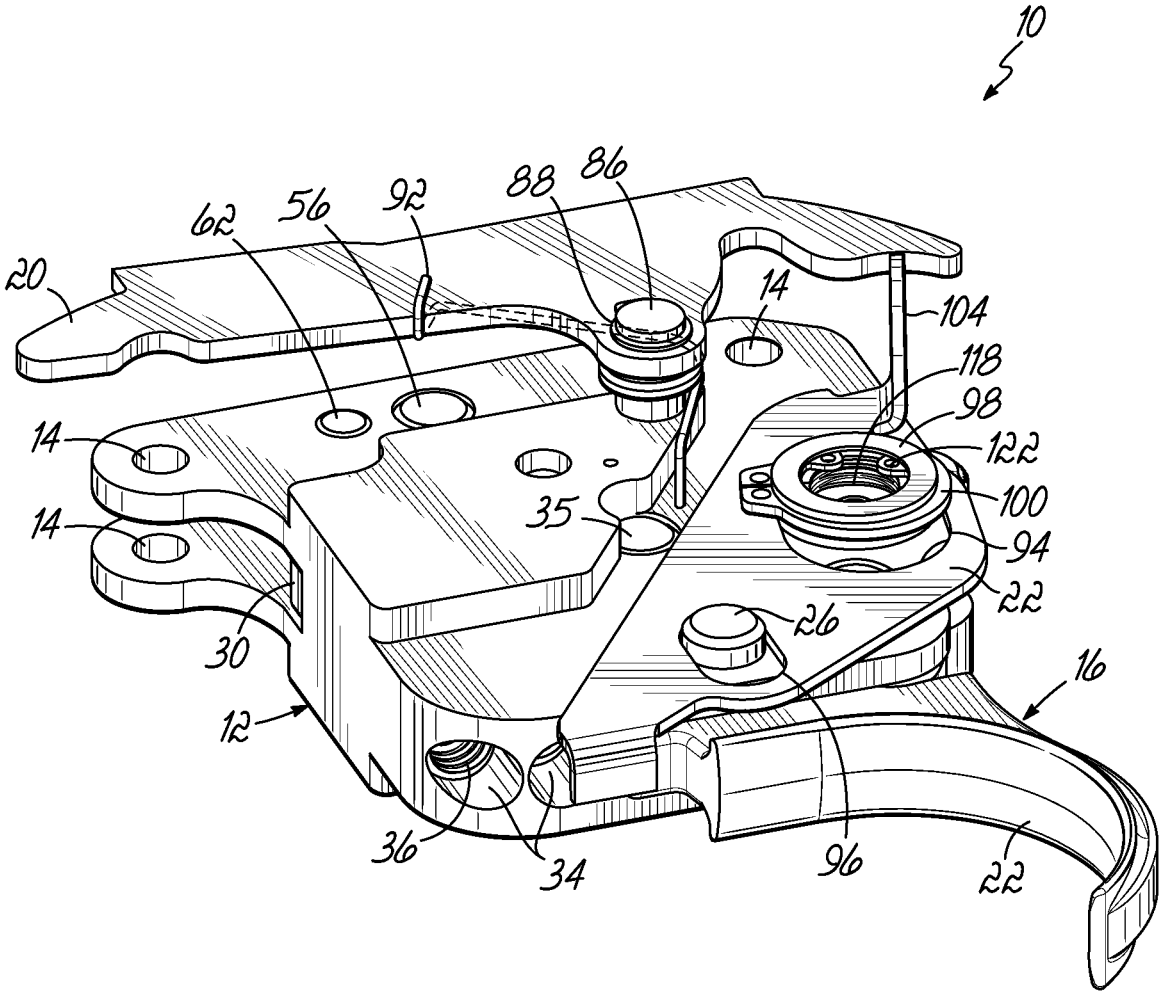
FIG. 8 is an isometric view of the assembly showing the captive bolt release mechanism.
Figure 9:
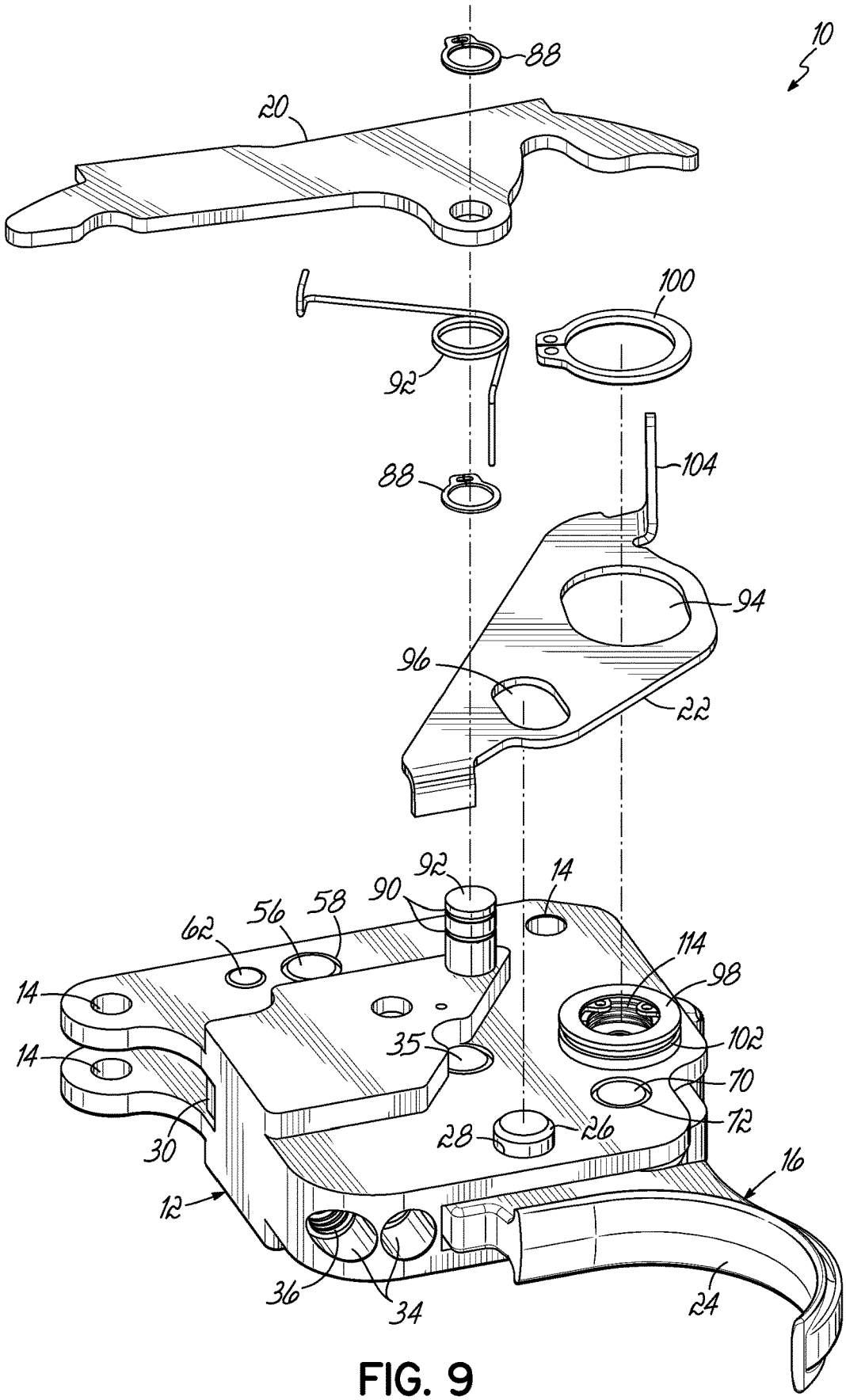
FIG. 9 is a similar view with the captive bolt release mechanism in an exploded position.

Referring now to FIGS. 8 and 9, therein is shown the bolt stop and release mechanism that can be made captive to the housing 12 so that the trigger assembly 10 may be installed as a "drop-in" unit. The bolt stop pivot pin 86 extends through both sidewalls of the housing 12 and outwardly therefrom to the left a distance as may be required by the particular model of receiver or firearm into which the trigger assembly 10 is being installed. The bolt stop 20 is pivotally mounted on the bolt release pivot pin 86 between snap rings 88 that fit into annular grooves 90 in the bolt release pivot pin 86. A torsion spring 92 is provided to bias a forward portion of the bolt stop 20 up, toward an engaged position. The release lever 22 includes elongated openings 94, 96 that fit over a detent boss 98 that extends from the left side of the housing 12 and a protruding portion of the trigger pivot pin 26. The release lever 22 is retained on the detent boss 98 by a snap ring 100 that engages an annular groove 102 on the detent boss 98.

When the release lever 22 is pushed upwardly, the elongated openings 94, 96 will slide along the detent boss 98 and protrusion of the trigger pivot pin 26. A slightly skewed orientation of one or both of the elongated openings 94, 96 will cause the release lever 22 to rotate as it slides, allowing the lateral finger 104 that engages a rear portion of the bolt stop 20 to follow the pivotal movement or "swing" of the bolt stop 20. Because the bolt release system is retained to the housing, installation of the unit 10 requires only insertion of the assembly pins through the assembly pin openings 14 of the housing without any loose parts. The only adjustment to be made is to the trigger springs 32 (weight of pull), which can be accessed either before or after assembly to the receiver and installation into a stock or chassis. Some custom receivers use a different bolt release mechanism that is integrated into the receiver. For such installations, the bolt catch 20, spring 92, lever 22, and snap rings 88, 100 can simply be removed and not used.

Figure 10:
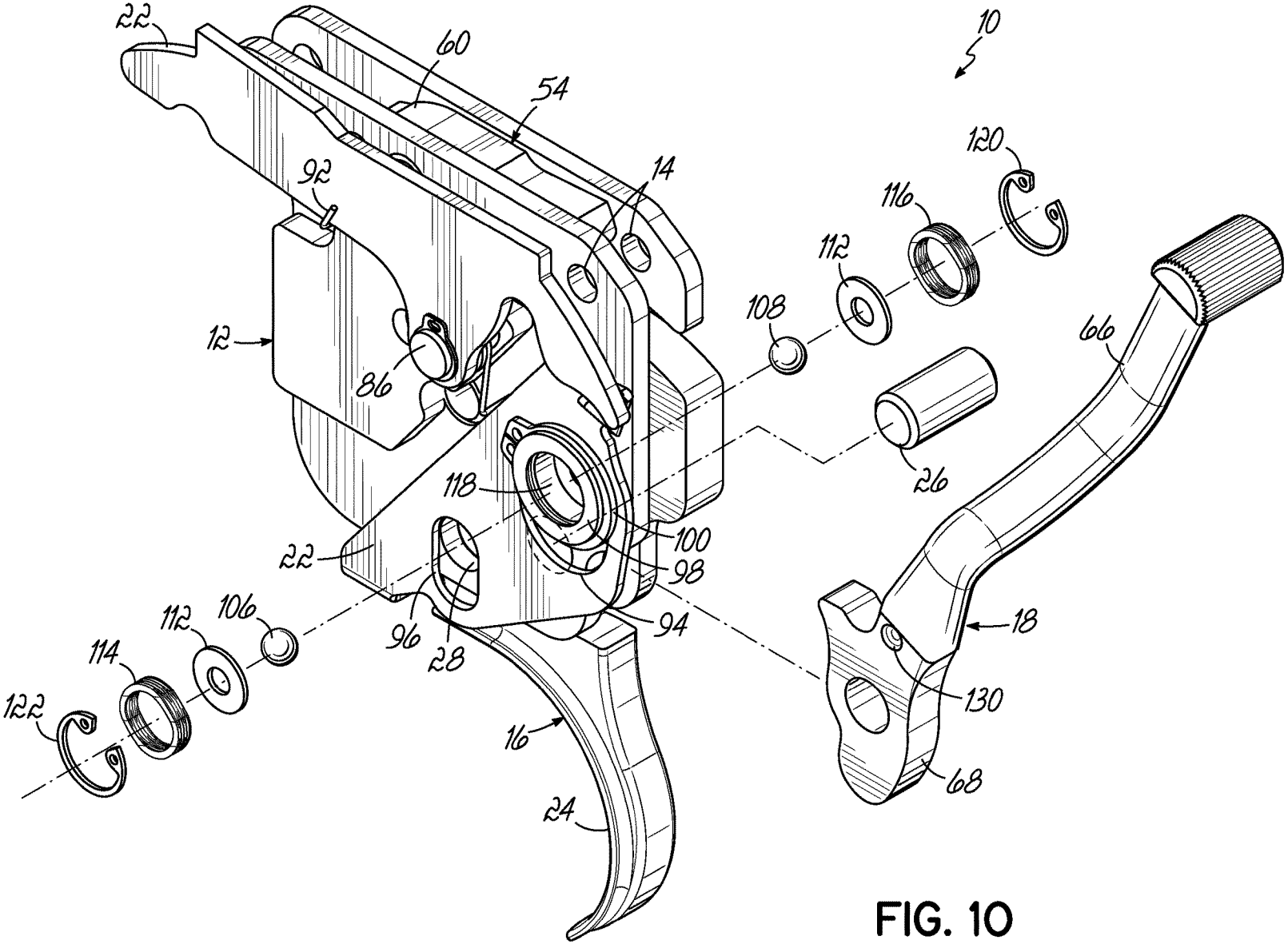
FIG. 10 is an exploded isometric view of the manual safety lever and detents.
Figure 11:
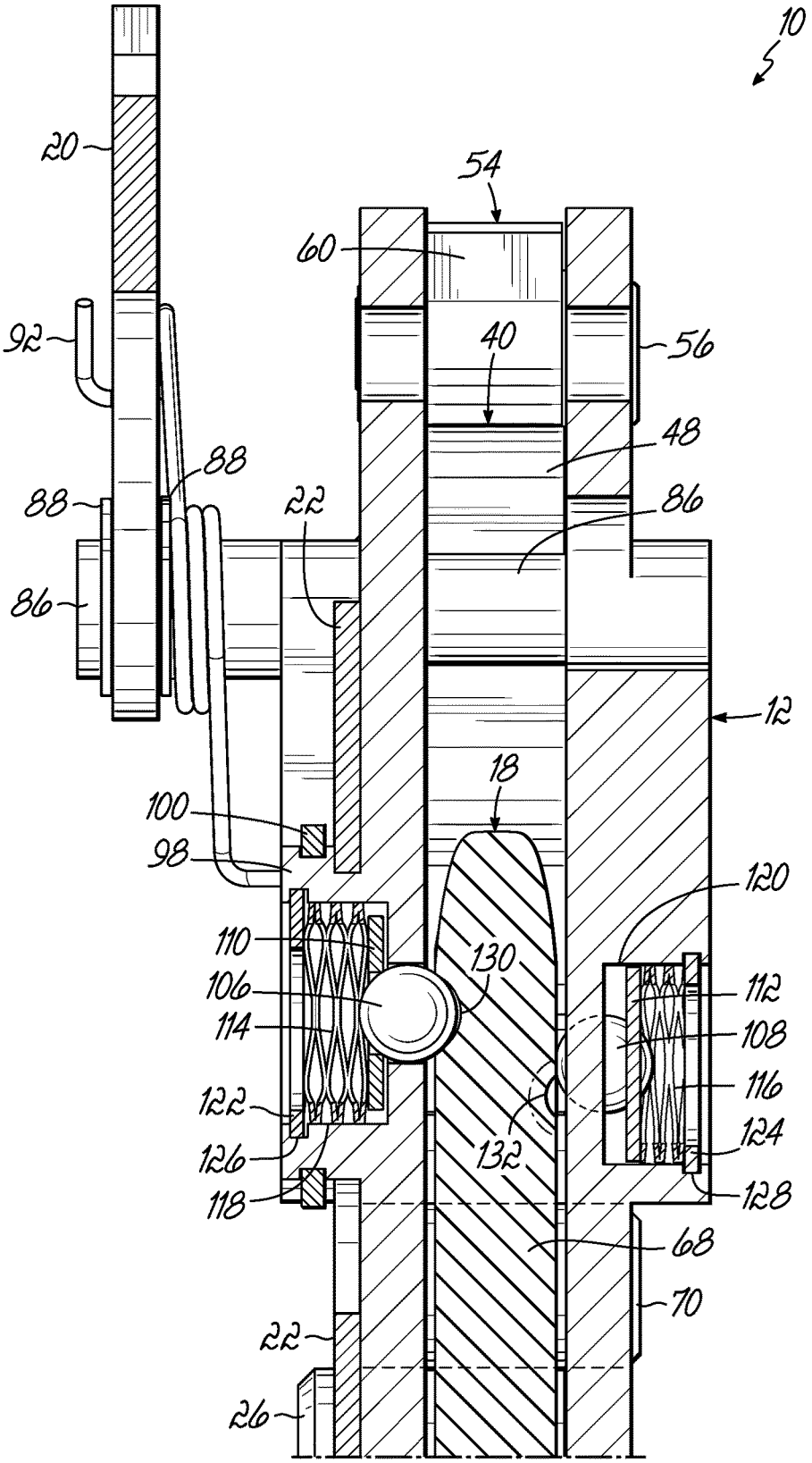
FIG. 11 is a fragmentary sectional view showing the safety lever detents.

Referring now to FIG. 10, therein is shown an exploded isometric view of the manual safety lever 18, pivot pin 70, and detent mechanism relative to the housing 12. The detent mechanism releasably holds the manual safety lever 18 in either the SAFE or FIRE position. Referring also to FIG. 11, each detent mechanism includes a detent ball 106, 108, a detent ball cup 110, 112, and a detent spring 114, 116. Each mechanism is received in a socket 118, 120 and held in place by an internal snap ring 122, 124 seated in an annular internal groove 126, 128. The detent ball cups 110, 112 can be in the form of simple washers and the detent springs 114, 116 can be wave springs (flat wire compression springs). When assembled, the springs 114, 116 press the detent balls 106, 108 toward the body portion 68 of the manual safety lever 18. Each ball 106, 108 will seat in a respective detent socket 130, 132 in the body portion 68 in the respective SAFE or FIRE position. In the illustrated embodiment, the detent for the SAFE position is on the left side and the detent for the FIRE position is on the right side. These could be reversed or modified to be combined on one side, including using a single detent ball with two detent sockets, or two detent balls with one detent socket.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm trigger mechanism, comprising:

a housing;

a trigger member pivotally mounted in the housing and movable between set and pulled positions;

a trigger dog pivotally mounted in the housing and a first lever arm portion of the trigger dog engaged to a lever arm portion of the trigger member by a first over-center linkage; and a striker dog pivotally mounted in the housing movable between set and released positions and including a lever arm portion of the striker dog engaged to a second lever arm portion of the trigger dog by a second over-center linkage, wherein the over-center linkages are configured to inhibit rotation of the striker dog from the set position to the released position until the trigger member is manipulated from the set position to the pulled position with a force greater than an engagement threshold of the over-center linkages.

2. The trigger mechanism of claim 1, wherein the housing is removably attachable to a firearm receiver.

3. The trigger mechanism of claim 2, wherein the housing is removably attachable with one or more assembly pins, none of which operate as a pivot axle for any pivoting part of the trigger mechanism.

4. The trigger mechanism of claim 1, wherein the trigger member is adjustably spring biased toward the set position.

5. The trigger mechanism of claim 1, further comprising a manual safety mechanism.

6. The trigger mechanism of claim 5, wherein the safety mechanism includes member with a portion pivotally mounted to the housing.

7. The trigger mechanism of claim 6, wherein the safety mechanism is movable between SAFE and FIRE positions and is configured to, when in the SAFE position, mechanically block movement of the trigger member from its set position.

8. The trigger mechanism of claim 7, wherein the safety mechanism is further configured to, when in the SAFE position, mechanically block movement of the trigger dog.

9. The trigger mechanism of claim 1, further comprising a bolt stop/release mechanism mounted on and captive to the housing without attachment to a receiver.

* * * * *